US007434797B2

(12) United States Patent
Okumura

(10) Patent No.: US 7,434,797 B2
(45) Date of Patent: Oct. 14, 2008

(54) RECORDING MEDIA PROCESSING DEVICE AND IMAGE FORMING DEVICE

(75) Inventor: Keiji Okumura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 310 days.

(21) Appl. No.: 11/258,907

(22) Filed: Oct. 27, 2005

(65) Prior Publication Data

US 2007/0096380 A1 May 3, 2007

(51) Int. Cl.
*B65H 37/04* (2006.01)

(52) U.S. Cl. ..... 270/58.09; 270/58.01; 270/58.08; 271/225; 271/302; 271/303

(58) Field of Classification Search ..... 270/58.01, 270/58.08, 58.09; 271/225, 302, 303
See application file for complete search history.

(56) References Cited

U.S. PATENT DOCUMENTS 5,655,765 A * 8/1997 Asami et al. ..... 271/185
6,764,236 B2 * 7/2004 Suzuki ..... 400/642

FOREIGN PATENT DOCUMENTS

JP 62130963 A * 6/1987
JP 02023156 A * 1/1990

* cited by examiner

*Primary Examiner*—Gene O. Crawford
*Assistant Examiner*—Leslie Nicholson, III
(74) *Attorney, Agent, or Firm*—Global IP Counselors, LLP

(57) ABSTRACT

The present invention comprises a shunting roller 41, and when recording media P, which is output from an image forming device main body 11, is stacked as a stack of recording media and staple processing is performed thereon, the shunting roller 41 rotates so as to receive subsequent recording media P in the wrapping direction thereof, while the first stack of recording media undergoes staple processing. The present invention also comprises a first branching pawl 44, for switching the direction of transport of recording media P between a transport path 42 and a processing unit 40, and a second branching pawl 47, for switching it between an output tray 45 and the shunting roller 41. Furthermore, a transport roller 53 for transporting the recording media P, is provided in the direction of transport between the first and second branching pawls 44 and 47, and cutaways 57 and 58 are formed in the first and second branching pawls 44 and 47 so as not to interfere with this transport roller 53, the transport roller 53 and the first and second branching pawls 44 and 47 being disposed so as to overlap when seen from the side.

7 Claims, 6 Drawing Sheets

RECORDING MEDIA PROCESSING DEVICE AND IMAGE FORMING DEVICE

FIELD OF THE INVENTION

The present invention relates to a recording media processing device disposed adjacent to an image forming device main body, and serving to perform after-processing such as punch processing and staple processing on recording media on which images have been formed, and to an image forming device such as a copier, a printer or a fax machine equipped with the same.

BACKGROUND INFORMATION

Conventionally, recording media processing devices are known which are disposed adjacent to the main body of an image forming device such as a copier or a printer and serve, for example, to perform after-processing (such as punch processing, staple processing and other binding processing) on recording media on which an image has been formed. These recording media processing devices perform staple processing (binding operation) and the like on recording media that has been output from the image forming device main body and stacked on a processing tray after passing through a transport path. Thus, when the stack of recording media undergoes staple processing, edge stapling or center stapling is performed by the stapler, but while staple processing is being performed in the processing tray, it is not possible to feed the next stack of recording media into the processing tray, and it is therefore necessary to provide a pause in the transport of the recording media during staple processing. However, this reduces the productivity of the recording media processing device.

Consequently, an after-processing device for image forming devices has been proposed which comprises, as shown in FIG. 6, a shunting roller 100 for receiving recording media during staple processing, transport paths 101*a* and 101*b* which are disposed substantially tangential to the shunting roller 100, and a shunting path 102 which is provided around the outer circumference of the shunting roller 100.

With this after-processing device, while a stack of recording media is undergoing staple processing in a stapling unit (not shown in the drawing), the shunting roller 100 rotates so as to receive the subsequent recording media, whereafter, when the staple processing is finished, the shunted recording media and the recording media output from the image forming device main body are fed to the stapling unit at the same time.

However, with the prior art described above, given the length, in the direction of transport, of the recording media that passes through the transport path 101*a* and the transport path 101*b*, it is necessary to provide a transport roller for transporting the recording media to the bottom of the shunting roller 100 (transport path side); and in the case of the prior art, a transport roller 103 is provided commonly on a mounting shaft for a branching pawl 104, as a result of which radial load and rotation are applied to this branching pawl 104, which results in malfunction.

Meanwhile, if the transport roller 103 is provided on a transport path 101*c*, downstream from a branching pawl 105, in the direction of transport, it is necessary to provide an additional separate transport roller on the shunting path 102, in the vicinity of the branching pawl 105. Furthermore, the prior art presents such problems as those wherein, when the recording media is transported to the stapling unit (not shown in the drawing), the transport roller 103 rotates in reverse, as a result of which, there is a risk of the edge of the recording media touching the transport roller 103 and jamming.

Thus, an object of the present invention is to provide a recording media processing device and an image forming device capable of smoothly switching the transport direction, with a first branching pawl and a second branching pawl, and having a transport roller provided in the direction of transport between the first and the second branching pawls so as to overlap therewith when seen from the side.

SUMMARY OF THE INVENTION

The recording media processing device according to a first aspect of the invention comprises: (1) a transport path for transporting recording media output from an image forming device main body; (2) a shunting roller disposed so as to border the transport path, for, when after-processing such as staple processing is performed on a stack of recording media, rotating, and thereby receiving subsequent recording media in the wrapping direction thereof, while the first stack of recording media is undergoing after-processing; (3) a first branching pawl disposed on the transport path, for switching the direction of transport of the recording media between the transport path and a processing unit that performs the after-processing; and (4) a second branching pawl disposed on the transport path, beyond the first branching pawl, for switching the direction of transport of the recording media between an output tray and the shunting roller.

The recording media processing device further comprises: a transport roller for transporting the recording media on the transport path, provided in the direction of transport between the first branching pawl and the second branching pawl; and cutaways formed in the first and second branching pawls so as not to interfere with the transport roller, the transport roller and the first and second branching pawls being disposed so as to overlap when seen from the side.

A recording media processing device according to a second aspect of the present invention is the device of the first aspect, wherein a plurality of transport rollers are provided at the outer circumference of the shunting roller so as to pair with, and be driven by, the shunting roller.

An image forming device according to a third aspect of the present invention includes an image forming device main body for forming images on recording media; and a recording media processing device, deposited adjacent to the image forming device main body, for performing after-processing such as staple processing on the recording media on which an image has been formed by the image forming device main body, wherein the recording media processing device is the recording media processing device according to the first or second aspect.

According to the present invention, a first branching pawl is disposed on the transport path for switching the direction of transport of the recording media between the transport path and the processing unit; a second branching pawl is disposed beyond the first branching pawl on the transport path for switching the direction of transport of the recording media between the output tray and the shunting roller; a transport roller is provided in the direction of transport between the first and second branching pawls; and cutaways are formed in the first and second branching pawls so as not to interfere with the transport roller, the transport roller and the first and second branching pawls being disposed so as to overlap when seen from the side, whereby the direction of transport of the recording media can be switched smoothly by the first and second branching pawls.

DETAILED DESCRIPTION OF THE PREFERRED EMBODIMENTS

Hereinafter a mode of embodiment of the image forming device according to the present invention is described with reference to the drawings.

Figure 1:
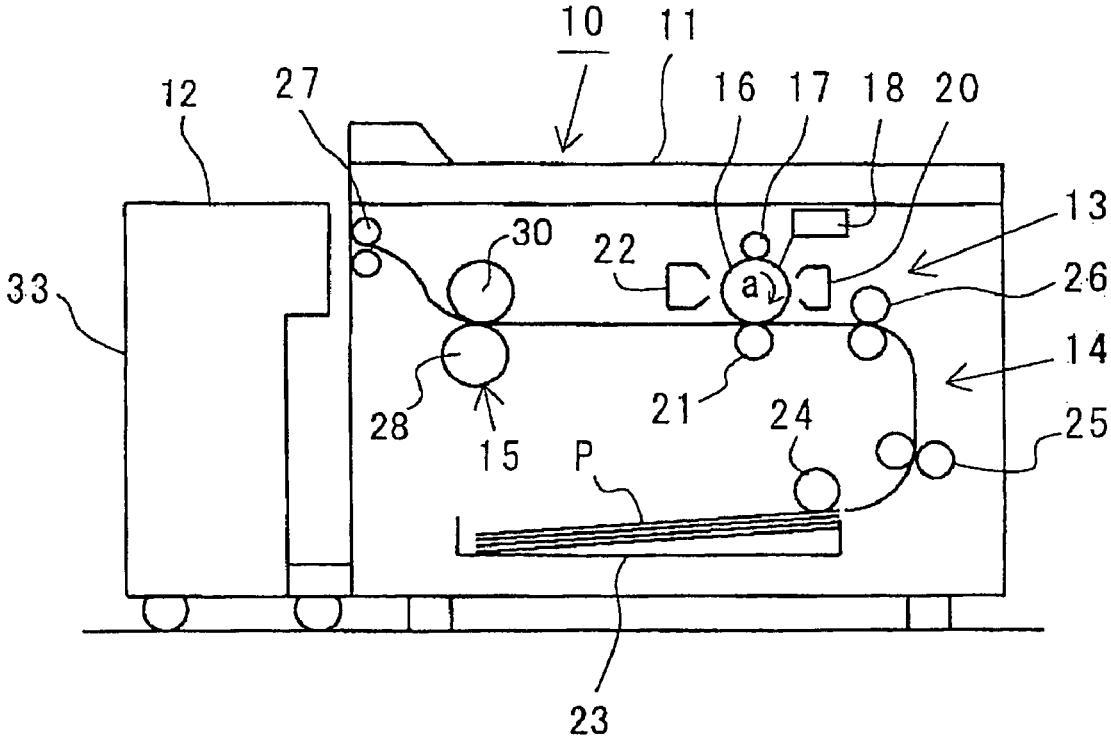
FIG. 1 is a view schematically illustrating the constitution of an image forming device in the present mode of embodiment.

FIG. 1 illustrates one example of an image processing device according to the present mode of embodiment. The figure is a longitudinal sectional view schematically illustrating the constitution of the image forming device in a simplified manner. An image forming device 10 comprises an image forming device main body 11 and a recording media processing device 12. This recording media processing device 12 is disposed adjacent to the image forming device main body 11.

Note that, in the present mode of embodiment, the image forming device 10 described is of the electrophotographic type and the recording media processing device 12 described comprises a stapler, but the image forming device and the recording media processing device according to the present invention are not limited to such devices.

Hereinafter the constitution and operation of the image forming device main body 11 are described, whereafter the constitution and operation of the recording media processing device 12 are described.

<Constitution and Operation of the Image Forming Device Main Body>

The image forming device main body 11 shown in FIG. 1 is an image forming device of the electrophotographic type, and comprises an image forming unit 13, a delivery unit 14 for delivering recording media P, and a fixing unit 15. Paper, plastic film, overhead projector sheets and the like can be used as the recording media P.

The image forming unit 13 comprises a photosensitive drum 16, which is rotationally driven in the direction of the arrow a, a primary charger 17, an exposer 18, a developer 20, a transfer charger 21, a cleaning unit 22 and the like, which are disposed substantially in this order around the drum 16 in the rotational direction thereof. The photosensitive drum 16 is formed by providing a photosensitive layer such as an OPC (organic photo semiconductor) on the outer circumferential face of a drum-shaped electroconductive substrate, and is rotationally driven at a predetermined process speed (peripheral velocity) in the direction of the arrow a, by a drive means which is not shown in the drawing.

The primary charger 17 comprises a charging roller (not shown in the drawing), which is disposed so as to contact the surface of the photosensitive drum 16, and a charging bias application power source (not shown in the drawing) for uniformly charging the surface of the photosensitive drum 16 to a predetermined polarity/potential by applying a charging bias to the charging roller. The exposer 18 comprises a laser scanner, a polygon mirror, a lens, a reflecting mirror, and the like that are not shown in the drawing, and exposes the surface of the charged photosensitive drum 16 in accordance with image data, so as to eliminate the charge in the exposed portions and form an electrostatic latent image thereon. The developer 20 comprises a developing container for storing developer (toner), a developing roller (not shown in the drawing) for carrying toner on the surface thereof from within this developing container and transporting it to a developing unit, and a developing bias application power source (not shown in the drawing) for developing a toner image by applying a developing bias to this developing roller and fixing toner onto the electrostatic latent image on the photosensitive drum 16.

The transfer charger 21 is disposed facing the photosensitive drum 16, so as to form the transfer unit with the photosensitive drum 16. Next, when a transfer bias is applied to the transfer charger 21 by the developing bias application power source, the toner image on the photosensitive drum 16 is electrostatically transferred to the recording media P, which is fed to the transfer unit from the delivery unit 14.

The cleaning unit 22 comprises a cleaning blade for removing toner that was not transferred to the recording media P during transfer but rather remained on the photosensitive drum 16 (residual toner).

The delivery unit 14 comprises, in order, in the direction of transport of the recording media P, a paper supply cassette 23, a paper feed roller 24, a pair of transport rollers 25, a pair of resist rollers 26, and a pair of paper output rollers 27. The paper supply cassette 23 stores a multiplicity of sheets of recording media P for forming toner images. The paper feed roller 24 serves to feed the recording media P in the paper supply cassette 23 one sheet at a time, and the pair of transport rollers 25 serve to transport the recording media P that has been fed thereto to the pair of resist rollers 26. The pair of resist rollers 26 temporarily stop the recording media P, which has been transported thereto by the pair of transport rollers 25, and subsequently supplies the recording media P to the transfer unit at timing that corresponds with the position of the toner image on the photosensitive drum 16. The pair of paper output rollers 27 are disposed at the top of one side 11*a* of the image forming device main body 11, and serve to output the recording media P on the surface of which the toner image has been fixed by the fixing unit 15, to the exterior of the image forming device main body 11.

The fixing unit 15 comprises a fixing roller 30, which houses a heater at the interior thereof, and a pressure roller 28, which is pressed against this fixing roller 30 and forms a fixing nip therewith. In the image forming unit 13, the recording media P. onto the surface of which the toner image has been transferred, is heated while it is held and transported through the fixing nip under pressure, so as to fuse and affix the toner image to the surface of the recording media, thereby fixing it.

In an image forming device main body 11 of this sort, a toner image is formed on the surface of the photosensitive drum 16, as a result of primary charging and exposure in the image forming unit 13. Meanwhile, the recording media P is supplied from the paper supply cassette 23 to the transfer unit in synchronization with the toner image on the photosensitive drum 16, by way of the paper feed roller 24, the pair of transport rollers 25 and the pair of resist rollers 26. Then, the toner image on the photosensitive drum 16 is transferred to the supplied recording media P by the transfer charger 21. The toner image is fixed on the surface of the recording media P onto which the toner image has been transferred, by the fixing unit 15, whereafter the recording media P is output to the exterior of the image forming device main body 11 by the pair of paper output rollers 27. In this manner, image formation is completed in the image forming device main body 11.

Note that, the recording media P that has been output to the exterior of the image forming device main body 11 by the pair of paper output rollers 27 is supplied to the recording media processing device 12.

<Constitution and Operation of the Recording Media Processing Device>

A recording media processing device 12 serves to perform after-processing, such as punch processing or stapling, on the recording media P, and performs these processes on the recording media P after an image is formed thereon by the image forming device main body 11.

Figure 2:
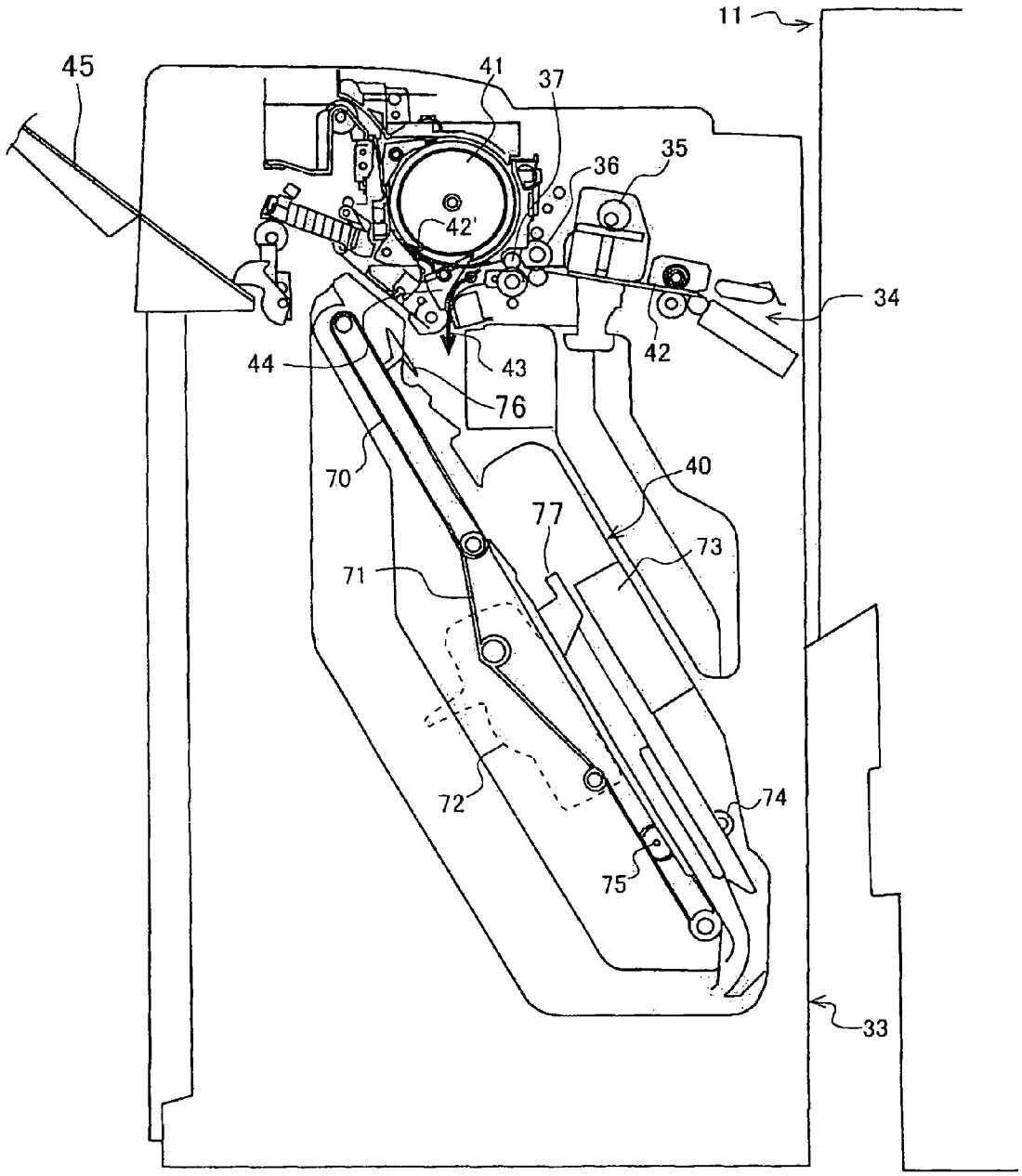
FIG. 2 is a sectional side view of a recording media processing device in the present mode of embodiment.

As shown in FIG. 2, the recording media processing device 12 comprises a rectilinear housing 33. At the top of the right sidewall of this housing 33 is provided an infeed opening 34 for the recording media P, at a position corresponding to the pair of paper output rollers 27 in the image forming device main body 11. Downstream from this infeed opening 34 is provided a transport path 42 for transporting the recording media P on which an image has been formed by the image forming device main body 11. Next, above this transport path 42 is disposed a punch processing unit 35 for performing hole punch operations on the recording media P, and downstream therefrom is disposed a pair of curl remover rollers 36, 37 for correcting curls in the recording media P. Furthermore, downstream from the pair of curl remover rollers 37, the transport path 42 branches into a transport path 42' that extends in the lengthwise direction thereof and a processing path 43 that extends downwards to a processing unit 40.

A first branching pawl 44, which is switched by a solenoid not shown in the drawing, is disposed on the transport path 42', at this branch point. In response to the solenoid being turned ON/OFF, this first branching pawl 44 is capable of switching the direction of transport of the recording media P between the transport path (shown by the bold arrow) 42', which extends in the lengthwise direction of the transport path 42, and the processing path (shown by the bold arrow) 43, which extends downward to the processing unit 40. Note that the transport path 42' extends substantially horizontally so as to border the shunting roller 41, as will be described in greater detail hereinbelow.

After branching downwards from the branch point on the transport path 42, the processing path 43 that extends to the processing unit 40 extends along an upper transport belt 70 and a lower transport belt 71, which extend at a downward inclination. An upper moving plate 76 is provided on the upper transport belt 70, so as to be united with this upper transport belt 70 and mobile therewith; and a lower moving plate 77 is provided on the lower transport belt 71 so as to be united with this lower transport belt 71 and mobile therewith. Furthermore, a stapler driver 72 and a stapler clincher 73 are disposed along this lower transport belt 71, in the transport direction thereof. Moreover, at the terminus of the lower transport belt 71, in the transport direction, are provided a feed roller 74 and a unit roller 75.

Next, in this processing unit 40, recording media P that has been fed in undergoes width alignment, stapling and the like, and after processing, the stack of paper is transported to a main output tray 45 or to a centerfold tray or the like not shown in the drawing. At this point, when the stack of recording media that has undergone after-processing is fed out to the main output tray 45, this is achieved by driving the upper transport belt 70 and the lower transport belt 71 so as to move the upper moving plate 76 and the lower moving plate 77 upwards, so as to push the stack of recording media up.

Figure 3:
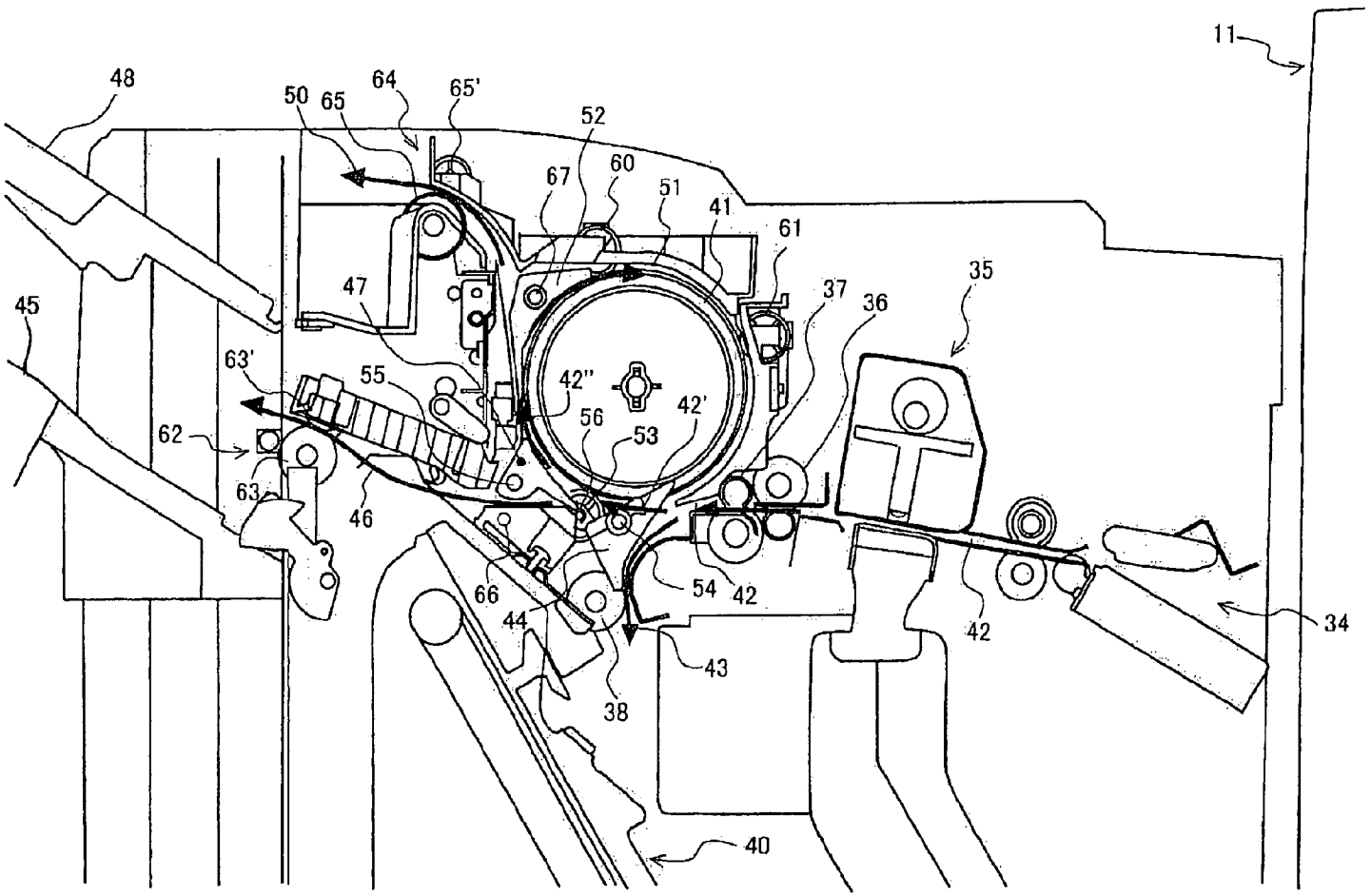
FIG. 3 is a partial enlarged view of the same.

Next, as shown in FIG. 3, the shunting roller 41 is disposed so as to border the transport path 42', which is the extension of the transport path 42, and a shunting path 51 for the recording media P is formed around the outer diameter of this shunting roller 41. Next, transport rollers 60 and 61, which pair with, and are rotationally driven by, the shunting roller 41, are provided on this shunting path 51; and a transport roller 53, described hereinbelow, which pairs with the shunting roller 41, is provided on the transport path 42', which is provided along the outer diameter of the shunting roller 41. The outer diameter of the shunting roller 41 can be determined in relation to the maximum size of the recording media P to be shunted, and must be long enough that the trailing edge of the recording media P that is shunted on the shunting path 51 and the leading edge of the next recording media P to be fed in do not overlap.

When after-processing such as staple processing is performed on a stack of recording media that is fed into the processing unit 40, while the first recording media stack undergoes after-processing, the shunting path 51 serves to receive and shunt subsequent recording media P in the wrapping direction thereof by rotating. Note that, while not shown in the drawing, a sensor is provided for detecting the leading edge of the recording media P that is wrapped onto the shunting roller 41, at a point slightly beyond the transport roller 61 on the circumference of the shunting roller 41.

Furthermore, a second branching pawl 47 is provided on the transport path 42' beyond the first branching pawl 44, for switching the direction of transport of the recording media P between an output transport path (shown by the bold arrow) 46, which leads to the main output tray 45 and a transport path (shown by the bold arrow) 42", which is provided along the shunting roller 41. In the present mode of embodiment, the transport path 42", which is provided along the shunting roller 41, and the shunting path 51 overlap in part.

Moreover, downstream from the transport path 42" is provided a third branching pawl 52 for switching the direction of transport of the recording media P, which has passed beyond the second branching pawl 47 along the transport path 42", between an output transport path (shown by the bold arrow) 50, which leads to a sub output tray 48, and the shunting path 51 in the wrapping direction of the shunting roller 41.

In the present mode of embodiment, the first branching pawl 44 described above is rigidly fixed to a shaft 54, the second branching pawl 47 is rigidly fixed to a shaft 55, and the third branching pawl 52 is rigidly fixed to a shaft 67; and these first through third branching pawls 44, 47 and 52 are controlled so as to switch the transport direction by rotating the shafts 54, 55 and 67 with solenoids that are not shown in the drawing. Furthermore, a drive roller 38, for transporting recording media P that has been fed into the processing path 43 to the processing unit 40, is provided on this processing path 43, below the first branching pawl 44.

Next, the transport roller 53 is provided so as to pair with and be driven by the shunting roller 41, as described above, on the transport path 42' between the first branching pawl 44 and the second branching pawl 47 in the transport direction. This transport roller 53 serves to transport recording media P positioned along the transport paths 42, 42' and 42" downstream, and is disposed so as to be separable from the shunting roller 41 by swinging, with respect to the shunting roller 41, around a pivot shaft 66.

Furthermore, in the present mode of embodiment, as viewed from the side, the first branching pawl 44, which is disposed on the transport path 42', overlaps with the transport roller 53, and the transport roller 53 overlaps with the second branching pawl 47.

Figure 4:
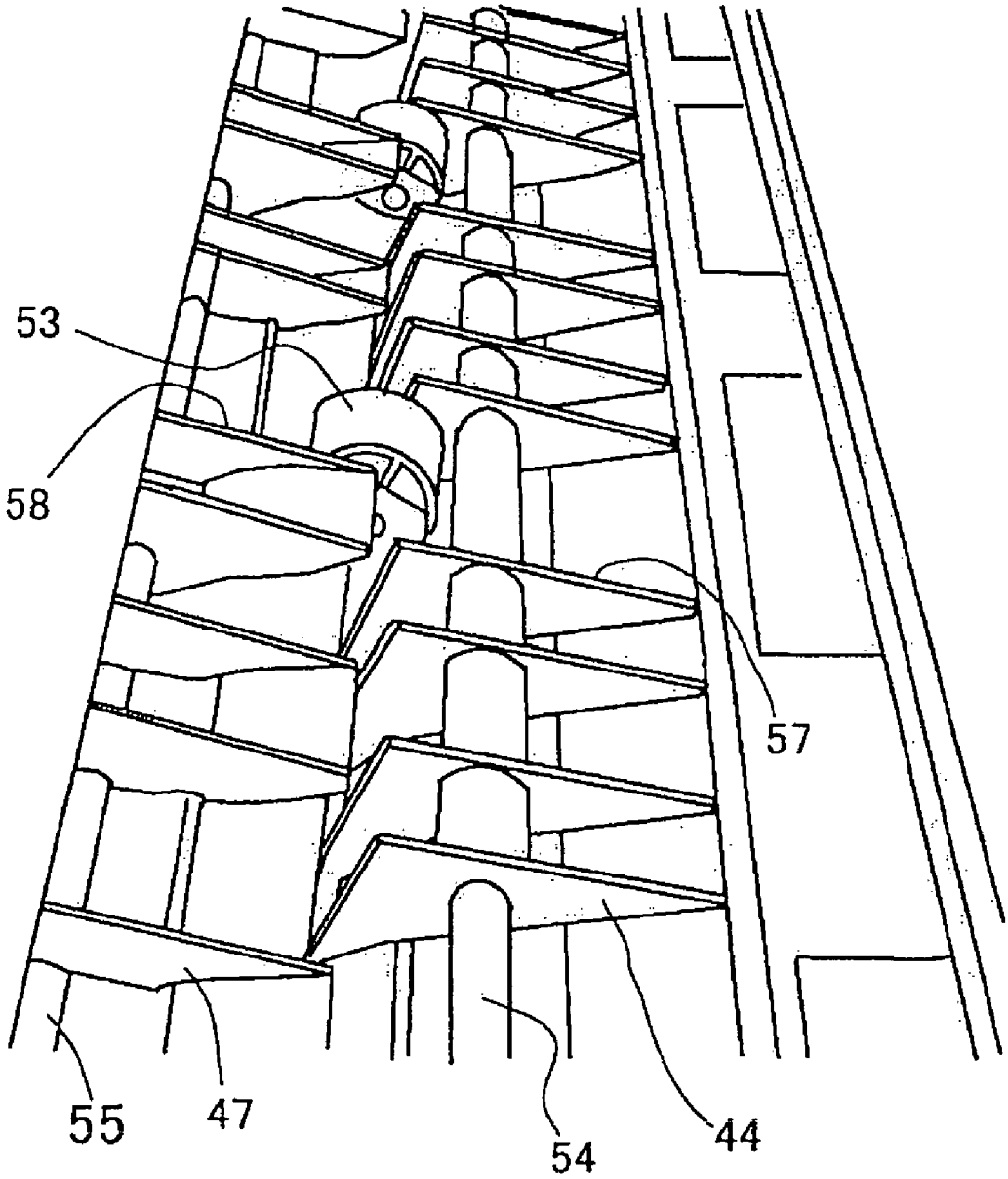
FIG. 4 is a view showing the relative positions of the transport roller and the first and second separation claws.

Specifically, as shown in FIG. 4, the first and second branching pawls 44 and 47 are rigidly fixed to the shafts 54 and 55 respectively, and the transport roller 53 is rotatably mounted on a shaft 56. Next, cutaways 57 and 58 are formed in the first branching pawl 44 and the second branching pawl 47 so as not to interfere with the transport roller 53. Because of these cutaways 57 and 58, when the first and second branching pawls 44 and 47 are rotated around the shafts 54 and 55 respectively, this rotation can be performed independently and smoothly without interfering with the transport roller 53.

Note that a pair of output rollers 62 consisting of a drive roller 63 and a driven roller 63', which contacts and is driven by the drive roller 63, is provided on the output transport path 46 leading to the main output tray 45; likewise a pair of output rollers 64 consisting of a drive roller 65 and a driven roller 65' is provided on the output transport path 50 leading to the sub output tray 48.

Furthermore, in the present mode of embodiment, the transport rollers 53, 60 and 61 are provided at the outer circumference of the shunting roller 41 so as to pair with the shunting roller 41 and be driven thereby, but the present invention is not limited to this and, for example, in place of the shunting roller 41 drive rollers may be separately provided for each of the transport rollers 53, 60 and 61 so as to rotate them.

<Action of the Recording Media Processing Device>

Figure 5:
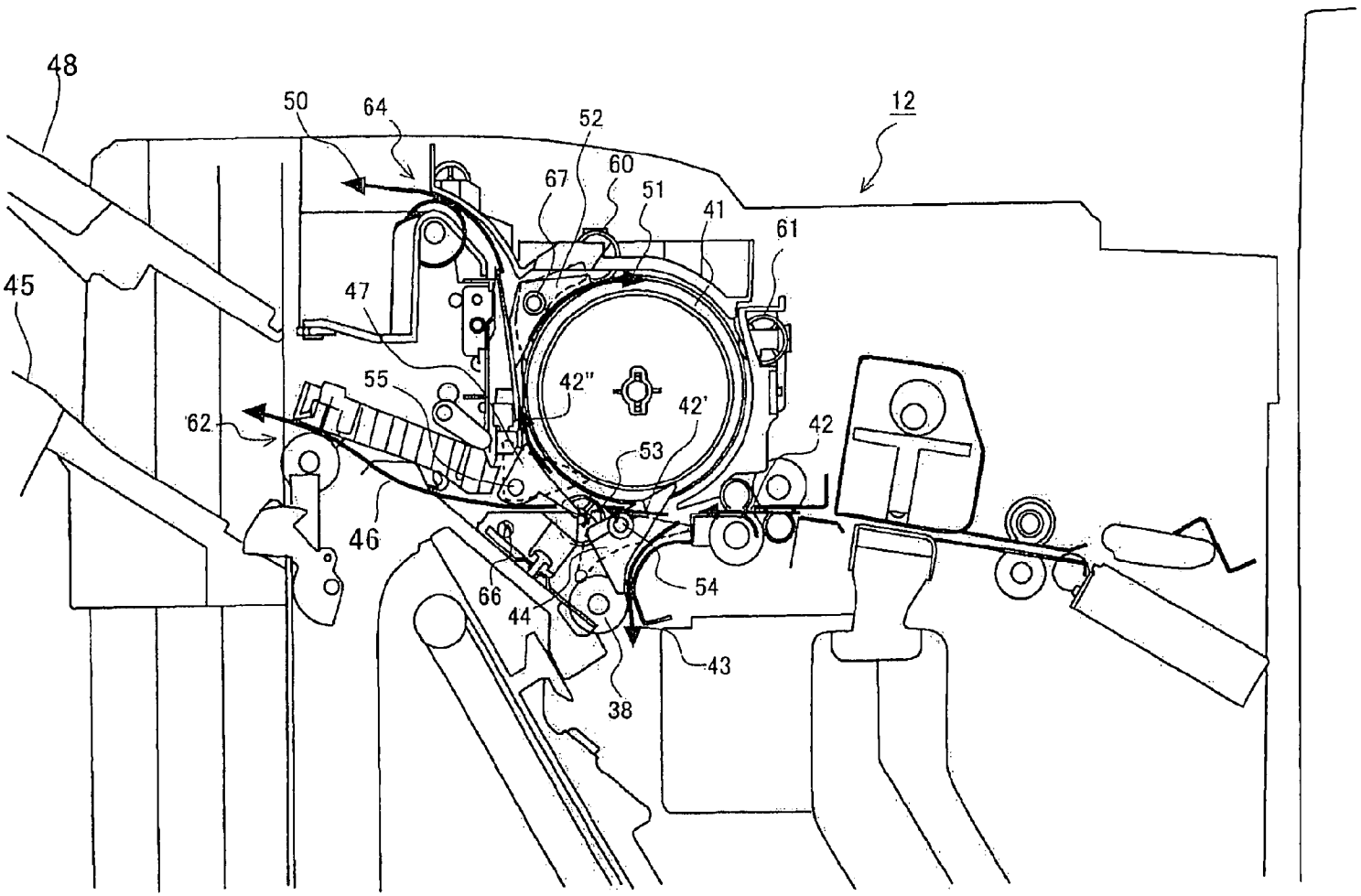
FIG. 5 is an enlarged side sectional view of key elements in the recording media processing device.
Figure 6:
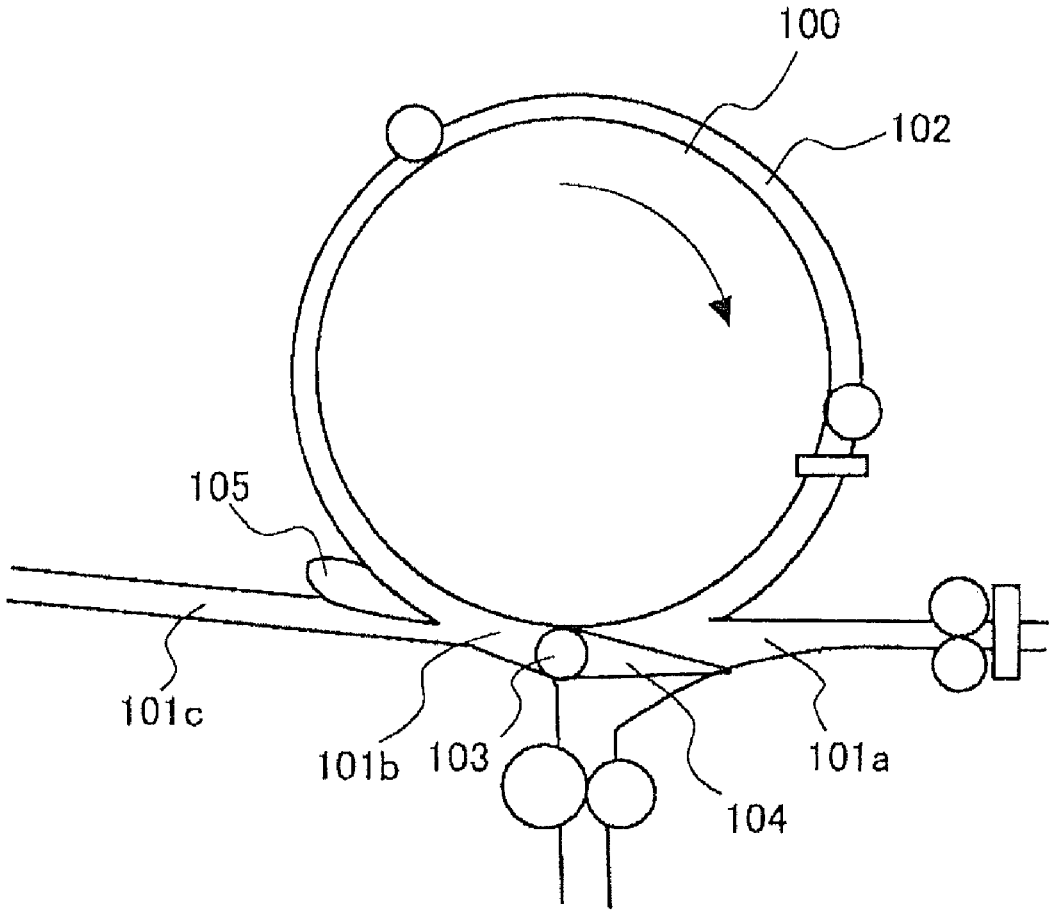
(Prior Art) Fig. 6
FIG. 6 is a side sectional view of a conventional recording media processing device.

FIG. 5 is a view showing the situation when the branching pawls 44, 47 and 52 are operated; hereinafter the action of the present mode of embodiment will be described with reference to this figure.

The recording media P that has been output from the image forming device main body 11 is fed into the interior of the recording media processing device 12 by way of the infeed opening 34 provided in the lateral face of the housing 33, and in the event that after-processing such as staple processing has not been selected, the first branching pawl 44 and the second branching pawl 47 are switched to the positions indicated by the dashed lines in the figure. Consequently, the recording media P is sent from the transport path 42, via the transport path 42', and by way of the output transport path 46, to the pair of output rollers 62, and output to the main output tray 45.

Furthermore, if the first branching pawl 44 is switched to the position indicated by the dashed line in the figure, the second branching pawl 47 is switched to the position indicated by the solid line in the figure, and the third branching pawl 52 is switched to the position indicated by the dashed line in the figure, the recording media P is sent from the transport path 42, via the transport paths 42', 42", and by way of the output transport path 50, to the pair of output rollers 64 and output to the sub output tray 48.

Moreover, if the first branching pawl 44 is switched to the position indicated by the dashed line in the figure, the second branching pawl 47 is switched to the position indicated by the solid line in the figure, and the third branching pawl 52 is switched to the position indicated by the solid line in the figure, the recording media P is transported from the transport path 42, via the transport paths 42', 42", to the shunting path 51 in the wrapping direction of the shunting roller 41.

Meanwhile, if after-processing such as stapling processing has been selected, the first branching pawl 44 is switched to the position indicated by the solid line in the figure, and the recording media is transported downward by the drive roller 38 and sent to the processing unit 40.

In cases where several stacks of recording media are to be fed into this processing unit 40, if staple processing or the like is being performed on the first recording media stack that has been fed into the processing unit 40, the first sheet of recording media P in the next recording media stack cannot be fed into the processing unit 40. Here, the first sheet of recording media P of the next recording media stack is shunted to the shunting path 51, which is formed along the outer diameter of the shunting roller 41, which rotates in the clockwise direction. In this case, the first branching pawl 44 is switched to the position indicated by the dashed line in the figure, and the second branching pawl 47 and the third branching pawl 52 are switched to the positions indicated by the solid lines in the figure. The leading edge of the recording media P that is shunted to the shunting path 51 is detected by a sensor, which is not shown in the drawing, at a short distance beyond the transport roller 61, and stopped in a predetermined position.

Next, the second sheet of recording media P is fed into the recording media processing device 12 from the image forming device main body 11, and when the staple processing of the first stack of recording media mentioned above is completed and this passes a sensor, which is not shown in the drawing, on the way to the pair of output rollers 62, the first branching pawl 44 switches to the position indicated by the solid line in the figure. After the leading edge of the second sheet of recording media P passes the sensor provided on the transport path 42, after a predetermined period of time, in which the second sheet of recording media P reaches a distance that is equal to the distance from the position of the leading edge of the stopped first sheet of recording media P to a point at which the leading edges of the first and second sheets of recording media P overlap, the shunting roller 41 begins to rotate once again so that transport of the first sheet of recording media P recommences, whereby the leading edges of the first and second sheets of recording media P overlap and are transported in the direction of the processing unit 40.

Note that, in the present mode of embodiment, a case has been described in which the first sheet of recording media P which has been wrapped onto the shunting roller 41 and the newly transported second sheet of recording media P are overlaid and transported to the processing unit 40, but if it is not possible to transport the recoding media P to the processing unit 40 with this timing, because of the copy speed and the staple processing time, a plurality of sheets of recording media P may be shunted to the shunting path 51, and these may subsequently be transported to the processing unit 40 in an overlaid state with the leading edges of the sheets of recording media P aligned.

Thus, according to the present mode of embodiment, the transport roller 53 is provided, in the direction of transport, between the first and second branching pawls 44 and 47, and cutaways 57 and 58 are formed in the first and second branching pawls 44 and 47, so as not to interfere with the transport roller 53; and the transport roller 53 and the first and second branching pawls 44 and 47 are disposed so as to overlap when viewed from the side, whereby switching of the transport direction for the recording media P by the first and second branching pawls 44 and 47 can be performed smoothly.

What is claimed is:

1. A recording media processing device comprising:

a transport path transporting recording media output from an image forming device main body;

a shunting roller being disposed to border the transport path, the shunting roller rotating when after-processing such as staple processing is performed on a first stack of recording media, and the shunting roller receiving subsequent recording media in a wrapping direction thereof while the first stack of recording media is undergoing after-processing, the shunting roller having a shunting path formed around an outer diameter of the shunting roller, and the subsequent recording media being wrapped around the shunting roller in the shunting path while the first stack of recording media is undergoing after-processing;

a first branching pawl being disposed on the transport path, the first branching pawl being rigidly fixed to and rotatable on a first shaft, the first branching pawl switching the direction of transport of the recording media by rotating the first shaft between the transport path and a processing unit that performs the after-processing;

a second branching pawl being disposed on the transport path, downstream of the first branching pawl, the second branching pawl being rigidly fixed to and rotatable on a second shaft, the second branching pawl switching the direction of transport of the recording media by rotating the second shaft between an output tray and the shunting roller; and a transport roller transporting the recording media, the transport roller being provided on the transport path in the direction of transport between the first branching pawl and the second branching pawl, the first and second branching pawls having cutaways being arranged not to interfere with the transport roller, the transport roller and the first and second branching pawls being disposed to overlap when seen from the side.

2. The recording media processing device according to claim 1, further comprising a third branching pawl arranged downstream of the second branching pawl, the third branching pawl being rigidly fixed to and rotatable on a third shaft, the third branching pawl switches the direction of transport between a sub output tray and the shunting roller by rotating the third shaft.

3. A recording media processing device comprising:

a transport path transporting recording media output from an image forming device main body;

a shunting roller being disposed to border the transport path, the shunting roller rotating when after-processing such as staple processing is performed on a first stack of recording media, and the shunting roller receiving subsequent recording media in a wrapping direction thereof while the first stack of recording media is undergoing after-processing;

a first branching pawl being disposed on the transport path, the first branching pawl switching the direction of transport of the recording media between the transport path and a processing unit that performs the after-processing;

a second branching pawl being disposed on the transport path, downstream of the first branching pawl, the second branching pawl switching the direction of transport of the recording media between an output tray and the shunting roller; and a plurality of transport rollers transporting the recording media, the plurality of transport rollers being provided at the outer circumference of the shunting roller to pair with, and be driven by, the shunting roller, the plurality of transport rollers being provided on the transport path in the direction of transport between the first branching pawl and the second branching pawl, the first and second branching pawls having cutaways being arranged not to interfere with the plurality of transport rollers, the plurality of transport rollers and the first and second branching pawls being disposed to overlap when seen from the side.

4. The recording media processing device according to claim 2, wherein the shunting roller has a shunting path formed around an outer diameter of the shunting roller, and the subsequent recording media is wrapped around the shunting roller in the shunting path while the first stack of recording media is undergoing after-processing.

5. The recording media processing device according to claim 4, further comprising a third branching pawl arranged downstream of the second branching pawl, the third branching pawl being rigidly fixed to and rotatable on a third shaft, the third branching pawl switches the direction of transport between a sub output tray and the shunting roller by rotating the third shaft.

6. An image forming device comprising:

an image forming device main body forming images on recording media; and a recording media processing device performing after-processing such as staple processing on recording media on which an image has been formed by the image forming device main body, the recording media processing device including a transport path transporting recording media output from an image forming device main body, a shunting roller being disposed to border the transport path, the shunting roller rotating when after-processing such as staple processing is performed on a first stack of recording media, and the shunting roller receiving subsequent recording media in a wrapping direction thereof while the first stack of recording media is undergoing after-processing, the shunting roller having a shunting path formed around an outer diameter of the shunting roller, and the subsequent recording media being wrapped around the shunting roller in the shunting path while the first stack of recording media is undergoing after-processing, a first branching pawl being disposed on the transport path, the first branching pawl being rigidly fixed to and rotatable on a first shaft, the first branching pawl switching the direction of transport of the recording media by rotating the first shaft between the transport path and a processing unit that performs the after-processing, a second branching pawl being disposed on the transport path, downstream of the first branching pawl, the second branching pawl being rigidly fixed to and rotatable on a second shaft, the second branching pawl switching the direction of transport of the recording media by rotating the second shaft between an output tray and the shunting roller, and a transport roller transporting the recording media, the transport roller being provided on the transport path in the direction of transport between the first branching pawl and the second branching pawl, the first and second branching pawls having cutaways being arranged not to interfere with the transport roller, the transport roller and the first and second branching pawls being disposed to overlap when seen from the side.

7. The image forming device according to claim 6, further comprising a third branching pawl arranged downstream of the second branching pawl, the third branching pawl being rigidly fixed to and rotatable on a third shaft, the third branching pawl switches the direction of transport between a sub output tray and the shunting roller by rotating the third shaft.

* * * * *